US007922595B2

(12) United States Patent
Libonati

(10) Patent No.: US 7,922,595 B2
(45) **Date of Patent: *Apr. 12, 2011**

(54) GOLF TRAINING AID

(76) Inventor: Michael R. Libonati, Winnetka, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/574,674

(22) Filed: Oct. 6, 2009

(65) Prior Publication Data

US 2010/0105495 A1 Apr. 29, 2010

Related U.S. Application Data

(63) Continuation of application No. 11/866,138, filed on Oct. 2, 2007, now Pat. No. 7,682,267, which is a continuation of application No. 11/394,328, filed on Mar. 28, 2006, now Pat. No. 7,297,078.

(60) Provisional application No. 60/667,712, filed on Apr. 1, 2005.

(51) Int. Cl.
*A63B 57/00* (2006.01)
*A63B 53/06* (2006.01)

(52) U.S. Cl. ..... 473/224; 473/234; 473/219

(58) Field of Classification Search ..... 473/422, 473/437, 457, 558–568, 519, 521, 523, 549, 473/552, 231, 234, 219, 221–226; D21/789
See application file for complete search history.

(56) References Cited

U.S. PATENT DOCUMENTS 2,135,648 A * 11/1938 Stumpf ..... 473/233
2,608,409 A * 8/1952 Pinkerton ..... 473/256
3,113,782 A 12/1963 Guier
3,173,326 A 3/1965 Saacson
4,253,666 A * 3/1981 Murphy ..... 473/288
4,330,121 A 5/1982 McCafferty
4,634,121 A 1/1987 Sasaki
4,794,905 A * 1/1989 Woolard ..... 124/5
4,809,975 A 3/1989 Lee
4,861,034 A * 8/1989 Lee ..... 473/202
5,133,551 A 7/1992 Handy et al.
D329,268 S * 9/1992 Perry ..... D21/791
5,577,966 A 11/1996 Duran
5,711,718 A * 1/1998 Mueller ..... 473/234
5,776,006 A * 7/1998 Gruber ..... 473/256
D404,097 S 1/1999 Tyner
D405,859 S 2/1999 Thompson
6,296,582 B1 10/2001 Minniear
6,371,866 B1 * 4/2002 Rivera ..... 473/288
D456,864 S 5/2002 Dantolan
6,406,387 B1 * 6/2002 Ryan ..... 473/457
6,461,163 B1 * 10/2002 Gallagher et al. ..... 434/252
6,599,200 B1 * 7/2003 Kallassy ..... 473/204
D485,325 S * 1/2004 Rohan-Weaver ..... D21/789
6,758,761 B2 7/2004 Katsuya
6,949,036 B2 9/2005 Ciesar et al.
7,048,640 B2 5/2006 Light
7,147,580 B2 12/2006 Nutter et al.
7,226,371 B2 6/2007 Leadbetter et al.
7,297,078 B2 11/2007 Libonati
7,682,267 B2 * 3/2010 Libonati ..... 473/457
2002/0072041 A1 6/2002 Gallagher et al.
2003/0036436 A1 * 2/2003 Casanova et al. ..... 473/202
2003/0144089 A1 7/2003 Ryan
2004/0048696 A1 3/2004 Ciesar et al.
2009/0088277 A1 4/2009 Libonati

* cited by examiner

*Primary Examiner* — Mitra Aryanpour
(74) *Attorney, Agent, or Firm* — Paul D. Chandler; Ocean Law

(57) ABSTRACT

A golf training aid utilizes a sliding ball assembly enabling sensory feedback for training golfers to make correct golf swings.

25 Claims, 4 Drawing Sheets

GOLF TRAINING AID

PRIORITY CLAIM

This utility patent application is a continuation of U.S. patent application Ser. No. 11/866,138 filed Oct. 2, 2007 now U.S. Pat. No. 7,682,267 which is a continuation of U.S. patent application Ser. No. 11/394,328 filed Mar. 28, 2006, now U.S. Pat. No. 7,297,078, which claims priority from Prov. Pat. Appl. No. 60/667,712 filed Apr. 1, 2005.

BACKGROUND OF THE INVENTION

1. Field of the Invention

The present invention relates to the mechanical arts. In particular, the invention relates to a training aid used by golf players to learn and/or improve golf playing techniques including swinging a golf club.

2. Discussion of the Related Art

Golfers have long trained with the implements of their sport to learn the game. The wooden clubs of the early 1900's have been improved by stronger and lighter parts made of metals and more recently composites. But, improvements in golf clubs have not led to similar improvements in aids and methods for training new golfers. Rather, developing effective aids and methods for training golfers has not been focused on by the industry.

SUMMARY OF THE INVENTION

The present invention discloses a training aid for players of the game of golf. In particular, the training aid is useful for teaching golfers proper swing mechanics. Taking a form similar to a golf club, the training aid has a relatively long shaft and is used, among other things, to train golfers how to make a proper golf swing.

The training aid employs a ball assembly that slides along a portion of the shaft during a swing. In various embodiments the travel of the ball assembly is limited to motion along the shaft and between first and second collars fixed to the shaft. The first collar is located near the club's hand grip and the second collar is located near the club's head.

The training aid provides visible and audible swing quality signals to the player. The use of a regulation or replica golf ball provides the player with a visual indication of correct swing timing. In addition, a distinct snap-like sound occurs when the ball assembly impacts the free-end collar. The sound triggers the memory at impact and allows the user to see the correct timing of the swing. This combined proprioceptive input enhances the player's awareness of hand-eye coordination and timing while conditioning and training the specific muscles used for swinging.

It is a further advantage of the training aid that a damper is incorporated in the ball assembly to reduce the mechanical shock when the ball assembly collides with the free-end collar. Coulomb damping resulting from friction between the ball and a damper tube inserted in the ball dissipates the energy of the collision resolving the shock and shock related swing distortion and wear problems associated with the repetitive collisions of contacting parts.

In an embodiment, a training aid for golfers comprises an elongated shaft having a free end and a handle end near an end opposing the free end. A damper tube is slidably engaged with the shaft and a replica golf ball is dampingly engaged with the damper tube. The ball and the damper tube are operative to move relative to each other when the free end of the shaft is swung toward the ground near a golfer's feet and the damper tube collides with a collar fixed to the shaft.

BRIEF DESCRIPTION OF THE DRAWINGS

Embodiments of the present invention are described herein with reference to the accompanying figures. The figures form part of the specification and together with it are intended to provide illustrative examples of the invention sufficient to enable a person of ordinary skill in the relevant art to make and use the invention.

DETAILED DESCRIPTION OF THE INVENTION

Figure 1A:
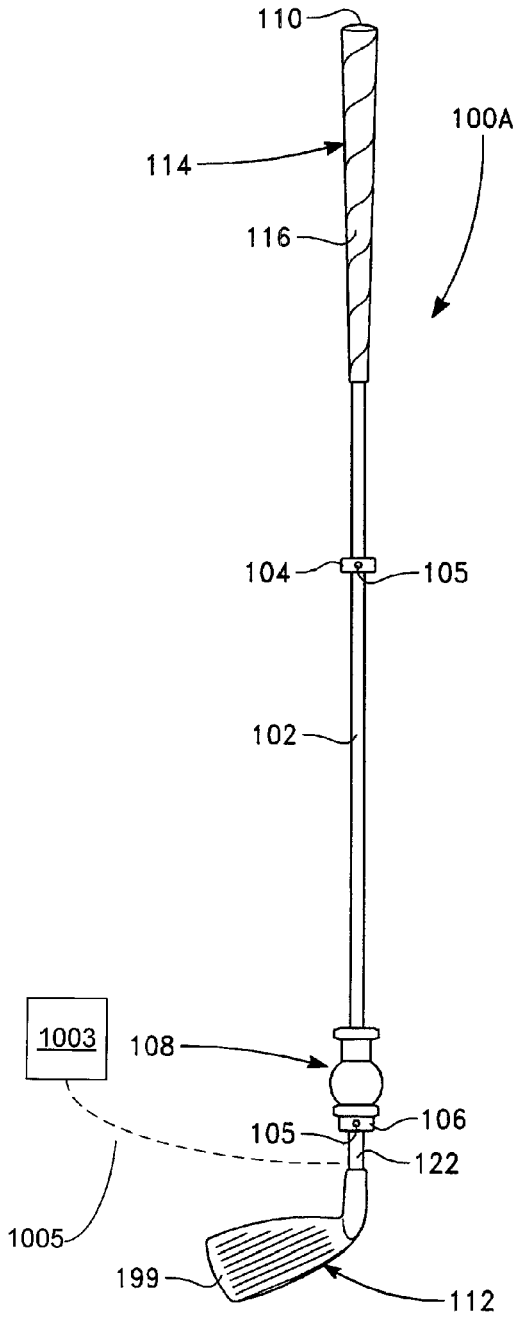
FIG. 1A shows a perspective view of a golf training aid in accordance with the present invention.

FIG. 1A shows a training club 100A in accordance with an embodiment of the present invention. The training club includes a shaft 102, a first collar 104, a second collar 106, and a replica golf ball assembly 108.

The shaft 102 of the training club 100A has a handle end 110 opposite a free-end 112. A handle section of the shaft 114 adjacent to the handle end provides space for the golfer to hold the club with two hands. While the golfer may hold the bare shaft, some embodiments provide a grip 116 attached to the handle section for, inter alia, improving the golfer's control of the club. As used herein, attachments, fixtures and the like include direct and indirect connections. In an embodiment, the shaft is a metallic tube such as a ferrous or nonferrous tube. In some embodiments, the shaft is made from composite materials such as a carbon composite construction. And, in some embodiments the weight of the training club and its weight distribution are similar to that of a regulation or standard golf club.

Figure 1B:
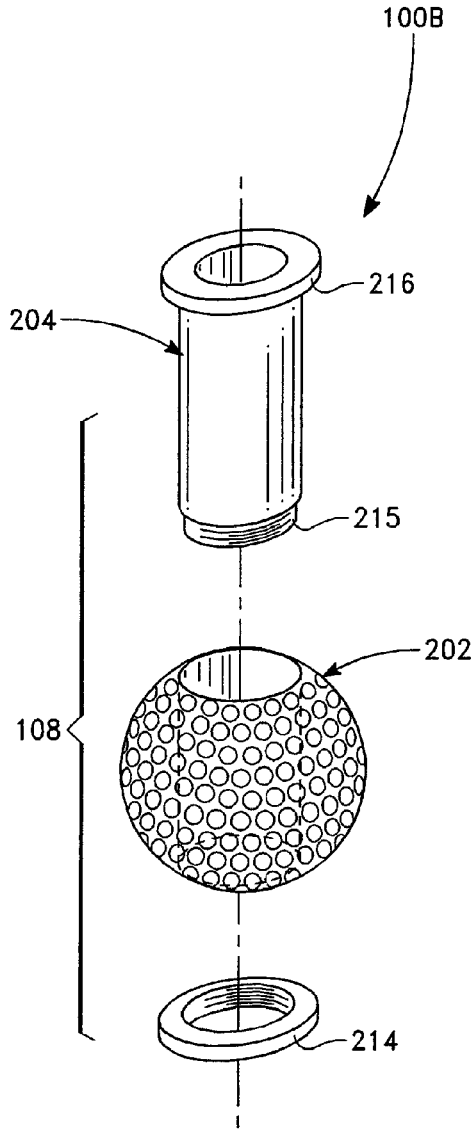
FIG. 1B shows parts of a ball assembly of the golf training aid of FIG. 1A.

FIG. 1B shows separated parts of the ball assembly 100B. The ball assembly 108 includes a replica golf ball 202 and a damper tube 204 having flanges at opposed ends. In an embodiment, a first flange 216 is part of the damper tube and a second flange 214 is for attachment to an opposed end 215 of the damper tube (as shown). In various embodiments, the flanges may be a part of or separate from the damper tube and means of attachment include permanent and removable attachments such as adhesives, mating threads, set screws, roll pins and other suitable attachments known to persons of ordinary skill in the art.

The ball assembly 108 is slidably engaged with the shaft 102. The first collar 104 is located between the handle section 114 and the free-end 112 of the club 100. The second collar 106 is located between the first collar and the free-end.

Together, the two collars limit the sliding motion of the ball assembly to a region of the shaft located between the two collars.

In an embodiment, the location of the collars 104, 106 may be adjusted, for example by use of a fastener such as a set screw 105. As used herein, fastener means any suitable fastener known to persons of ordinary skill in the art such as screws, clamps, bolts, roll pins and spring operated catches. Adjustment of the collars provides a means to select the length and region of the shaft 102 traversable by the ball assembly 108. In some embodiments the weights of the collars are varied to adjust club weight, club balance and/or club response. For example, in some embodiments the weight of the second collar is increased for strength training.

Figure 2A:
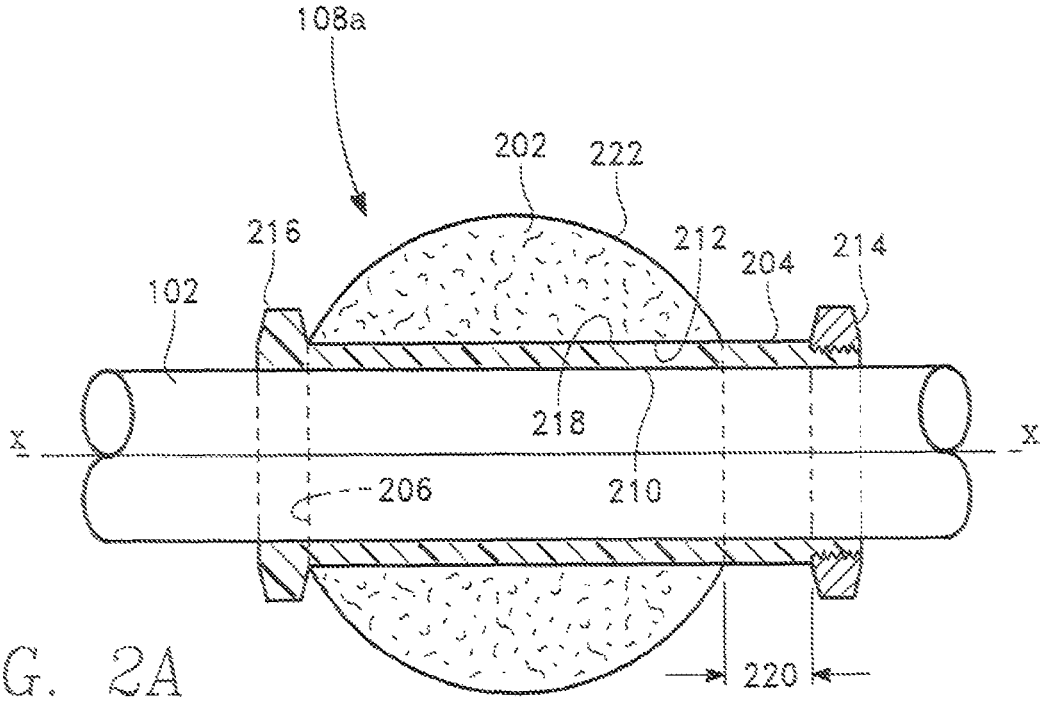
FIG. 2A shows a first cross-sectional view of an assembled ball assembly of the golf training aid of FIG. 1A.
Figure 2B:
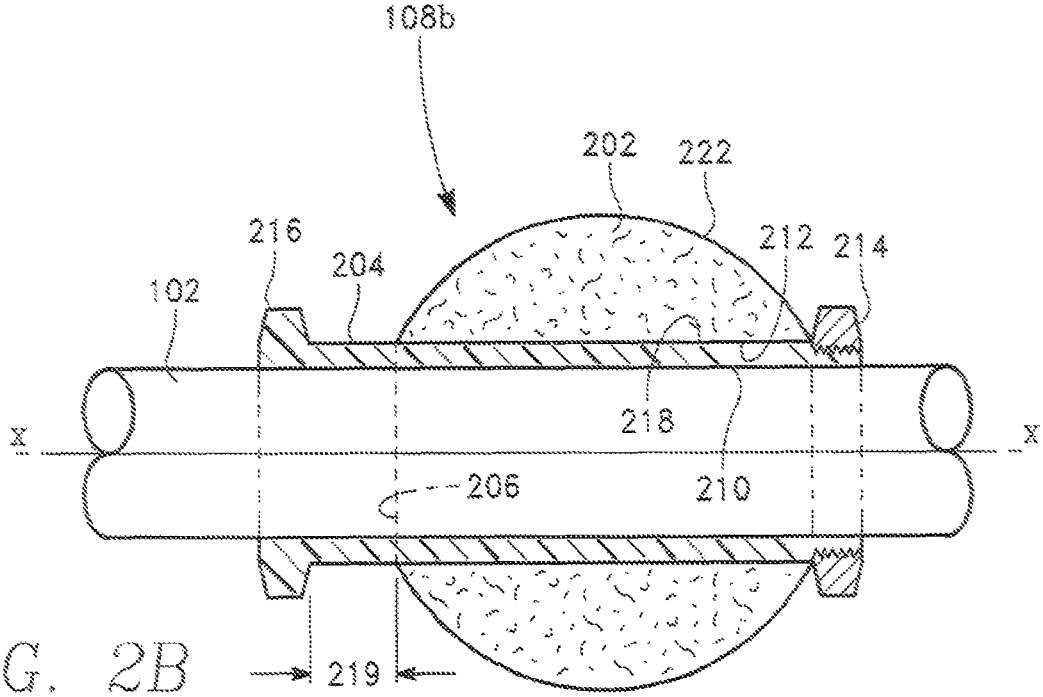
FIG. 2B shows a second cross-sectional view of an assembled ball assembly of the golf training aid of FIG. 1A.

FIGS. 2A and 2B show assembled golf ball assemblies 108*a*, 108*b*. The ball assembly includes a replica golf ball 202, for example a regulation golf ball or another suitable replica of a golf ball, and a damper tube 204 that is inserted in a through hole 206 in the ball.

In an embodiment, the hole 206 has a substantially constant cross-sectional area defining a geometric centerline that is about coextensive with an axis x-x passing through the center of the ball. In some embodiments, the replica golf ball is a regulation golf ball with a through hole. And, in some embodiments, the golf ball is made from one or more materials including a suitable jacket material such as a polymer, for example plastic, and a suitable core material such as a resilient polymer, for example rubber, plastic or the like.

The damper tube 204 has an inner surface 210 and means at opposed ends to limit the travel of the ball 202 that slides on the tube. In various embodiments, the damper tube has a first flanged end 216, and a second flanged end 214.

Figure 3A:
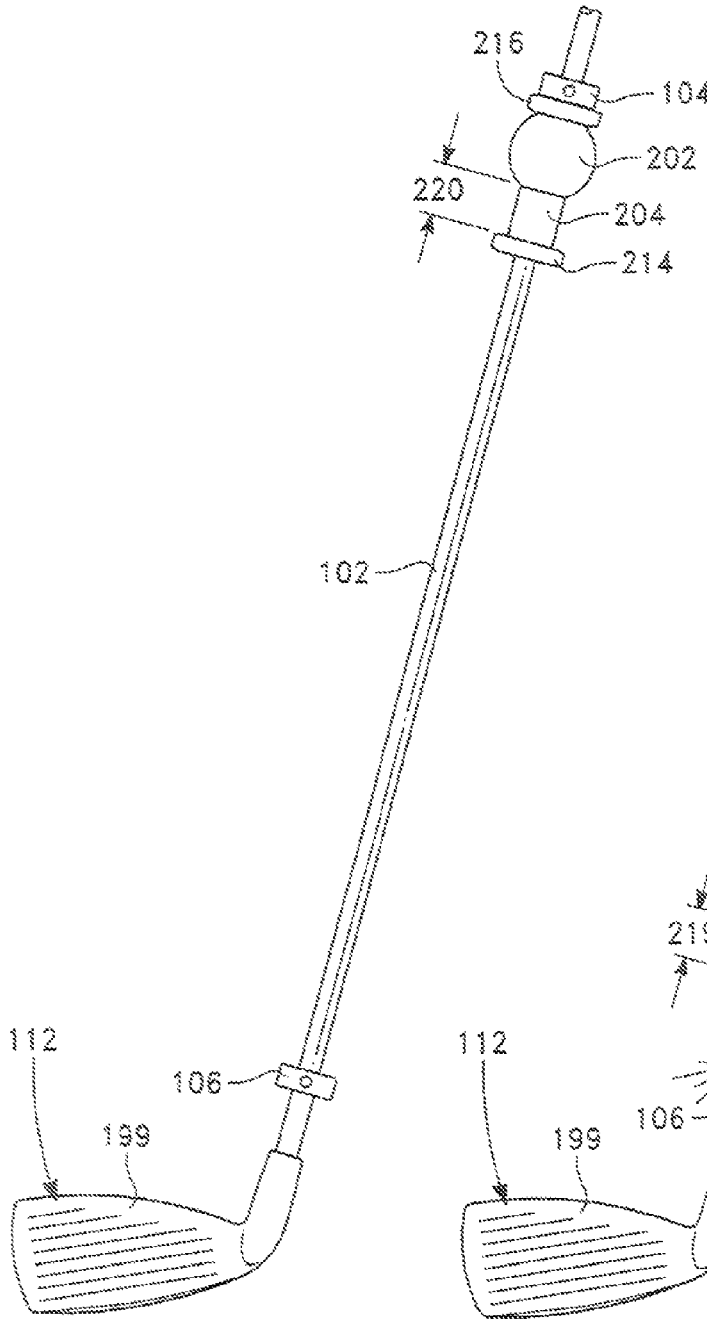
FIG. 3A shows a first perspective view of a shaft and club head portion of the golf training aid of FIG. 1A.
Figure 3B:
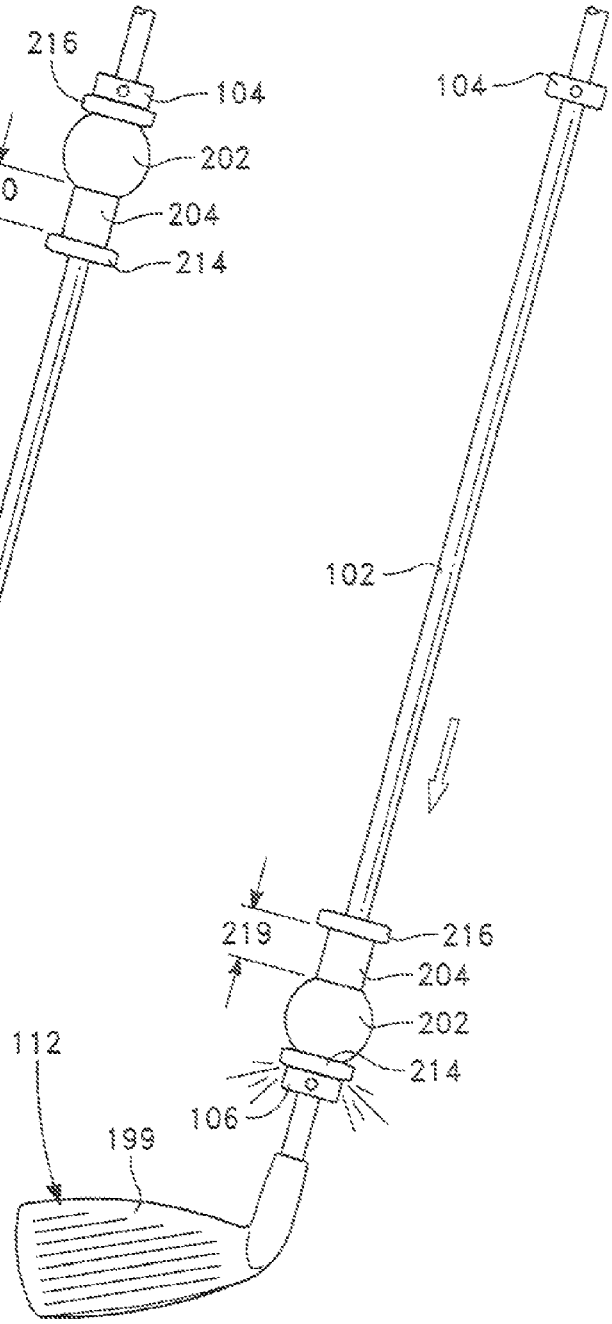
FIG. 3B shows a second perspective view of a shaft and club head portion of the golf training aid of FIG. 1A.

Referring also to FIGS. 3A and 3B, the second flanged end 214 is for striking the second collar 106. In some embodiments, the flange and collar materials and/or structures are chosen to audibly emphasize the collar/flange contact. In an embodiment, one or both of the flange and collar are resonant metal structures such as structures with thin peripheral rims or diaphragms.

In an embodiment, the first flanged end 216 is for striking the first collar 104 (as shown) and in another embodiment, the first flanged end 216 is for striking the second collar 106. In some embodiments, the flange and collar materials and/or structures are chosen to audibly emphasize the collar/flange contact. In some embodiments one or both ends of the damper tube are butt ends and in some embodiments one or both ends of the damper tube are flanged ends. In an embodiment, the damper tube is preferably made from a polymeric material such as polyethylene.

The outer surface of the damper tube 218 is in sliding contact and/or dampingly engaged with the side walls of the through hole 212 since the fit between the outer surface of the damper tube and the side walls of the through hole is an interference fit (gap shown in FIGS. 2A and 2B is for clarity). The amount of interference, material, and material surface properties determine the force required to overcome the related frictional forces tending to prevent the ball 202 from sliding along the damper tube 204. In an embodiment, the damper tube and the through-hole 206 have generally circular cross-sections.

In another embodiment, a suitable resilient material such as textiles including felts and piled materials or an elastomer such as a foam material is interposed between the outer surface of the damper tube 218 and the side walls of the through hole 206. Preferably, the resilient material is attached to the side walls of the through hole such that the damper tube 204 slides with respect to an adjacent surface of the resilient material which rubs against it. In an embodiment the resilient material is an elastomer such as an open-cell foam.

In an embodiment, an electronic signaling device 122 is mounted within the shaft 102, stub shaft 602 and/or within the second collar 106. The signaling device emits an audible sound in response to the second flanged end of the damper tube 214 reaching the second collar 106. In an embodiment, an electronic sensing and signaling device provides swing diagnostics information including swing dynamics based on data acquired from sensors during the swing. Exemplary sensors used for this purpose include one or more of accelerometers for sensing relative motion and radio wave type locators including global positioning systems (GPS) and similar systems for obtaining position based on trilateration. Diagnostics are reported to the player and/or other persons using one or more of lighted indications and audible sounds emanating from the training aid and remote printers or video displays. In some embodiments the swing diagnostics are reported by a speech generator 1003 in signal communication 1005 with the electronic signaling device.

Various embodiments of the invention are used to train and/or improve a golfer's swing. The golfer handles the training club in a manner that is similar to the way a regulation or standard club would be handled. When a swing is made the ball assembly 108 moves from its rest against the first collar 104, along the shaft 102, and impacts the second collar 106 with an audible snap-like sound.

When the ball assembly 108 is at rest against the first collar 104, the first flanged end of the damper tube 216 is about flush with an outer surface of the replica golf ball 222 and the second flanged end of the damper tube 214 has its maximum projection 220 from the outer surface of the replica golf ball as shown in FIGS. 2A and 3A. When the ball assembly 108 nears the free-end of the training club 112, the second flanged end of the damper tube 214 strikes the second collar 106. The mechanical shock of this collision and the resulting wear of the colliding parts is reduced by Coulomb or frictional damping when the ball drags along the outer surface of the damper tube 218 and absorbs a portion of the energy/shock of the collision. Where electronic signaling devices 122 are mounted in the training club 100A, the Coulomb damping of the ball assembly tends to preserve the life of these electrical and/or electronic devices by reducing the mechanical shocks experienced during training.

When the ball assembly 108 comes to rest against the second collar 106 the first flanged end of the damper tube 216 has its maximum projection 219 from the outer surface of the ball 222 and the second flanged end of the damper tube 214 is about flush with the outer surface of the ball as shown in FIGS. 2B and 3B.

In another embodiment, preparation for another swing requires only that the golfer raise the training club 100A during the backswing to restore the damper tube's maximum projection 220. Here, the backswing causes the ball assembly 108 to slide back toward the club's handle end 114 causing the first flanged end of the damper tube 216 to strike the first collar 104. This collision causes the ball 202 to slide relative to the damper tube 204 until the first flanged end of the damper tube 216 is about flush with the outer surface 222 of the ball 202.

The ball 202 and the damper tube 204 are operative to move relative to each other when the free end of the club 112 is swung toward the ground near a golfer's feet and the damper tube collides with a collar fixed to the shaft 106.

Here, the ball and the damper tube are operative to dissipate kinetic energy of the ball when relative motion between the ball and the damper tube causes coulomb damping to occur.

In various embodiments, the training club provides a golfer with one or more signals from which to judge the quality of his swing. First, the "feel" of the swing informs the golfer about the swing. Since the training club uses a replica golf ball 202 rather than a weight, neither the swing dynamics nor the related player sensations are distorted when the ball slides along the length of the shaft 102 during the swing. Second, the replica golf ball is easily observed by the golfer as the free-end of the training club 112 passes in front of the golfer. A correct swing is one in which the golfer observes the ball reaching the second collar of the club 106 just as the club head 199 reaches the ball. Third, the sound of the damper tube flange 214 striking the second collar 106 provides a timed, audible indication of when the club should be striking the ball.

Figure 4:
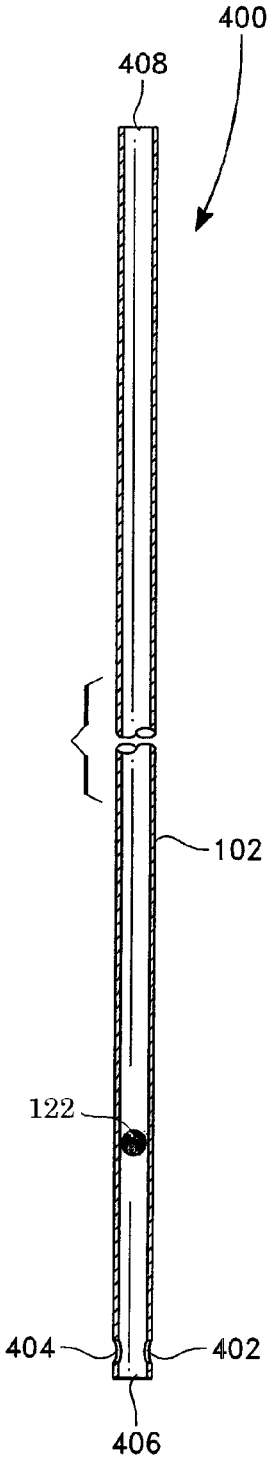
FIG. 4 shows a perspective view of a shaft of the golf training aid of FIG. 1.
Figure 5A:
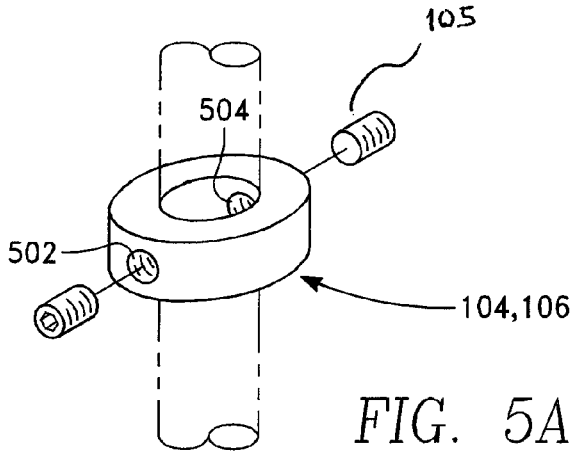
FIGS. 5A-C show a stop collar of the golf training aid of FIG. 1.
Figure 5B:
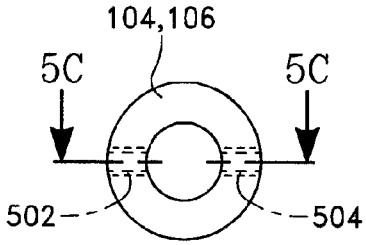
Figure 5C:
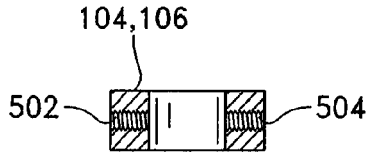

In some embodiments, the club head 199 can be removed. For example, FIG. 4 shows a golf training aid shaft portion 400 having upper and lower ends 408, 406. Here, the shaft 102 has generally opposed holes 402, 404 to receive set screws 105 mated with the second stop collar 106. FIGS. 5A-C show the generally opposed and threaded set screw holes 502, 504 of the second stop collar. When the stop collar is located over the holes in the shaft and the shaft holes are aligned with the stop collar holes, set screws penetrating the shaft holes provide a stop collar locking mechanism.

Figure 6:
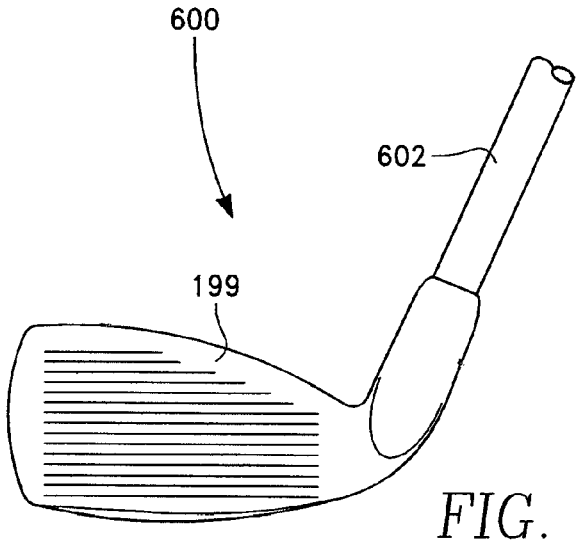
FIG. 6 shows a club head and stub shaft of the golf training aid of FIG. 1.

FIG. 6 shows an exemplary removable club head assembly 600 that can be used with the second stop collar 106 and shaft 102. Here, the lower end of the shaft 406 has a bore dimensioned to receive a stub shaft of the club head assembly and the tightening of the set screws 105 passing through the opposed holes of the shaft 404, 406 locks the club head assembly to the shaft. A removable club head enables club head substitution with varying club heads including heavier or lighter heads and heads matching those used on a particular golf club such as a 9-iron.

In some embodiments, the stop collars 104, 106 and in particular, the second stop collar 106 provide a means of selectively weighting the golf training aid 100A. For example, removal of the second stop collar set screws 105 from the shaft 102 enables removal and replacement of the stop collar where a removable club head 199 is used. If the head is not removable, the grip 116 and upper stop collar 105 can, for example using a design similar to that of the second stop collar, be removed to achieve the same result. Among other things, removable stop collars enable substitution of lighter or heavier collars as may be desired by the user.

While various embodiments of the present invention have been described above, it should be understood that they have been presented by way of example only, and not limitation. It will be understood by those skilled in the art that various changes in form and details can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A training aid for golfers comprising:

a damper tube slidably engaged with a shaft;

a golf club head fixed near a distal end of the shaft;

a replica golf ball having a central bore and dampingly engaged with the damper tube;

the ball and the damper tube operative to move relative to each other when a free end of the shaft is swung toward the ground near a golfer's feet and the damper tube collides with a stop collar fixed to the shaft; and, the ball and the damper tube operative to dissipate kinetic energy of the ball when relative motion between the ball and the damper tube causes coulomb damping to occur.

2. The golf training aid of claim 1 wherein the diameter of the shaft is substantially constant.

3. The golf training aid of claim 2 further comprising:

a club head assembly including the club head and a stub shaft; and, a fastener interoperating with the stop collar and the shaft and locking the club head assembly to the shaft.

4. The golf training aid of claim 3 further including:

a swing diagnostics means integral with the training aid;

wherein the motion of the ball relative to the shaft provides visual swing quality signals; and, wherein the swing diagnostics means provides audible swing quality signals.

5. The golf training aid of claim 4 wherein the swing diagnostics means produces an audible electronic sound at the time the damper tube collides with a second stop collar.

6. The golf training aid of claim 4 wherein the swing diagnostics means acquires swing data utilizing trilateration during the swing and analyzes the data to provide an indication of swing quality.

7. The golf training aid of claim 6 wherein the swing quality indication is conveyed visually.

8. The golf training aid of claim 6 wherein the swing quality indication is conveyed audibly.

9. The golf training aid of claim 6 wherein the swing quality indication is conveyed by synthesized speech.

10. A training aid for golfers comprising:

an elongated shaft having a handle end for a golfer's two hands and a free end;

a damper tube slidably engaged with the shaft and disposed between first and second stop collars located on the shaft;

a club head assembly including a club head and a stub shaft;

a fastener interoperating with the second stop collar and the shaft and locking the club head assembly to the shaft; and, a replica golf ball dampingly engaged with the damper tube for providing Coulomb damping when the shaft is swung and the damper tube collides with the second stop collar.

11. The golf training aid of claim 10 wherein the diameter of the shaft is substantially constant.

12. A training aid for golfers comprising:

an elongated shaft having a handle end for a player to grasp and a free end;

a damper tube slidably engaged with a distal portion of the shaft and disposed between first and second stop collars located on the shaft;

a replica golf ball dampingly engaged with the damper tube for providing Coulomb damping when the shaft is swung and the damper tube collides with the second stop collar;

wherein the motion of the ball relative to the shaft provides visual swing signals to the player; and, wherein the collision between the damper tube and the second stop collar provides audible swing signals to the player.

13. The golf training aid of claim 12 further comprising:

a club head assembly including a club head and a stub shaft; and, a fastener interoperating with a stop collar and the shaft and locking the club head assembly to the shaft.

14. A training aid for golfers comprising:

an elongated shaft having a handle end for a golfer to grasp and a free end;

a damper tube slidably engaged with the shaft and disposed between first and second stop collars located on the shaft;

a replica golf ball dampingly engaged with the damper tube for providing Coulomb damping when the shaft is swung and the damper tube collides with the second stop collar;

a swing diagnostics means integral with the training aid;

wherein the motion of the ball relative to the shaft provides visual swing quality signals; and, wherein the swing diagnostics means provides audible swing quality signals.

15. The golf training aid of claim 14 wherein the swing diagnostics means produces an audible electronic sound at the time the damper tube collides with the second stop collar.

16. The golf training aid of claim 14 wherein the swing diagnostics means acquires swing data utilizing trilateration during the swing and analyzes the data to provide an indication of swing quality.

17. The golf training aid of claim 16 wherein the swing quality indication is conveyed visually.

18. The golf training aid of claim 16 wherein the swing quality indication is conveyed audibly.

19. The golf training aid of claim 16 wherein the swing quality indication is conveyed by synthesized speech.

20. A method of preventing damage caused by mechanical shock to an electronics device affixed to a golf training aid having a slidably engaged member comprising the steps of:

engaging a damper tube in slidable relationship with a shaft of a golf training aid;

limiting the movement of the damper tube with a stop collar located on the golf training aid;

engaging a replica golf ball in damping relationship with the damper tube;

affixing an electronics sensing and signaling device to the golf training aid; and, utilizing Coulomb damping between the replica golf ball and the damper tube to reduce mechanical shock imparted to sensing and signaling electronics of the golf training aid when the shaft is swung and the damper tube collides with the stop collar.

21. The training aid of claim 1 wherein the damper tube encircles the shaft.

22. The training aid of claim 1 wherein the coulomb damping results from an interference fit between the ball and the damper tube.

23. The damage preventing method of claim 20 wherein the damper tube, shaft, stop collar, ball and sensing and signaling electronics are parts of a golf training aid in the form of a golf club.

24. The damage preventing method of claim 20 wherein the Coulomb damping transforms mechanical energy into heat.

25. The damage prevention method of claim 20 further comprising the step of wearing one or both of the damper tube and the ball during Coulomb damping.

* * * * *